US009877521B1

(12) United States Patent
Gillis

(10) Patent No.: US 9,877,521 B1
(45) Date of Patent: Jan. 30, 2018

(54) VAPORIZER, VAPORIZER CARTRIDGE, VAPORIZER ASSEMBLY, AND METHOD OF USE THEREOF

(71) Applicant: Vapor Slide LLC, Boulder, CO (US)

(72) Inventor: Brendan P. Gillis, Boulder, CO (US)

(73) Assignee: Vapor Slide LLC, Boulder, CO (US)

( * ) Notice: Subject to any disclaimer, the term of this patent is extended or adjusted under 35 U.S.C. 154(b) by 0 days.

(21) Appl. No.: 15/445,545

(22) Filed: Feb. 28, 2017

(51) Int. Cl.
*A24F 47/00* (2006.01)
*H05B 1/02* (2006.01)

(52) U.S. Cl.
CPC ..... *A24F 47/008* (2013.01); *H05B 1/0244* (2013.01); *H05B 2203/021* (2013.01)

(58) Field of Classification Search
None
See application file for complete search history.

(56) References Cited

U.S. PATENT DOCUMENTS 8,739,786 B2 6/2014 Postma
8,869,792 B1 10/2014 Lee
9,693,588 B2 * 7/2017 Zhu ..... A24F 47/008
9,750,284 B2 * 9/2017 Rado ..... A24F 47/008
2015/0007836 A1 * 1/2015 Li ..... A24F 47/008 131/329
2015/0257443 A1 9/2015 Rado
2016/0000147 A1 * 1/2016 Li ..... A24F 47/008 131/329
2016/0073692 A1 * 3/2016 Alarcon ..... A24F 47/008 131/329
2017/0112192 A1 * 4/2017 Shan ..... A24F 47/008

* cited by examiner

*Primary Examiner* — Tho D Ta
(74) *Attorney, Agent, or Firm* — Levine Bagade Han LLP

(57) ABSTRACT

A vaporizer assembly comprising a vaporizer and a detachable cartridge is disclosed. The vaporizer comprises a vaporizer housing comprising a frustoconical portion, an airflow entry port, and at least one seal ring surrounding the frustoconical portion. The cartridge comprises a cartridge chamber comprising a chamber wall encapsulating a chamber space configured to hold a vaporizable liquid, a heating chamber within the cartridge chamber, wherein the heating chamber comprises at least one fluid entrance port along a surface of the heating chamber configured to facilitate entry of the vaporizable liquid from the chamber space into a chamber interior within the heating chamber, and a heating element within the chamber interior configured to heat the vaporizable liquid within the chamber interior into a vapor.

18 Claims, 10 Drawing Sheets

VAPORIZER, VAPORIZER CARTRIDGE, VAPORIZER ASSEMBLY, AND METHOD OF USE THEREOF

TECHNICAL FIELD

The present disclosure relates generally to the field of vaporizers; more specifically, to a vaporizer assembly for use with water pipes or as a standalone handheld vaporizer.

BACKGROUND

Vaporizers are devices used to heat and release the active ingredients of plant material, including tobacco, herbs, or other medicinal plants by heating the oils or vaporizable liquids of such plant material. Users generally prefer vaporizing the oils, extracts, or concentrates of plant material (or vaping) over smoking (i.e., burning) such plant material since smoking often involves the inhalation of many irritating, toxic, and carcinogenic by-products released by the burning process.

In recent years there has been growing interest in the use of vaporizers with water pipes where the water in such pipes further filters and cools the vapor produced by the vaporizer. However, most traditional portable vaporizers are not designed to fit within a downstem of a water pipe. Moreover, airflow through such portable vaporizers is often not optimized for use with a water pipe. While some desktop vaporizers have incorporated water reservoirs into their designs, such vaporizers are often bulky and require a connection to an electrical outlet which makes using such vaporizers on-the-go difficult.

In addition, vaporizers often include a refillable cartridge or cartomizer for holding oils or other vaporizable liquids. Such cartridges can be difficult to fill and often require the disassembly of a signification portion of either the vaporizer or cartridge in order to access the finable chamber of the cartridge.

Accordingly, a vaporizer solution is needed which optimizes the device for use with most conventional water pipes. In addition, such a solution should be portable, discrete, and allow the vaporizer to be used on its own (i.e., without a water pipe). Moreover, such a solution should also allow for the easy refill of the vaporizer cartridge.

SUMMARY

A vaporizer assembly comprising a vaporizer and a detachable cartridge is disclosed herein. The vaporizer can comprise a vaporizer housing comprising a frustoconical portion and an airflow entry port positioned along the frustoconical portion. The vaporizer housing can be made from an aluminum alloy.

The airflow entry port can be part of an airflow pathway extending through the vaporizer assembly. The airflow entry port can be a circular port and the airflow entry port can have a diameter between 1.3 mm and 1.5 mm. The vaporizer can also have least one seal ring surrounding the frustoconical portion.

The vaporizer assembly can also comprise a cartridge detachably coupled to the vaporizer. The cartridge can comprise a cartridge chamber comprising a chamber wall encapsulating a chamber space configured to hold a vaporizable liquid and a heating chamber positioned within the cartridge chamber. The cartridge chamber can have a chamber proximal end and a chamber distal end opposite the chamber proximal end. At least part of the chamber wall can be made from a transparent glass material.

The heating chamber can comprise at least one fluid entrance port along a surface of the heating chamber configured to facilitate entry of the vaporizable liquid from the chamber space into a chamber interior within the heating chamber and a heating element within the chamber interior configured to heat the vaporizable liquid within the chamber interior into a vapor.

The heating element of the cartridge can comprise at least two heating coils positioned within the chamber interior. The at least two heating coils can be resistive heating coils comprising an iron-chromium-aluminum alloy. The at least two heating coils can be positioned substantially horizontal within the chamber interior such that a coil longitudinal axis of one of the two heating coils is substantially perpendicular to a chamber longitudinal axis of the heating chamber. In addition, each of the at least two heating coils can be wound around a wicking material configured to soak up the vaporizable liquid. Moreover, the cartridge can further comprise an insulator within the chamber interior and coupled to the heating element.

The chamber interior can be in fluid communication with the airflow pathway and an outside environment and air flowing through the airflow pathway can carry the vapor out of the vaporizer assembly.

The cartridge can further comprise a cartridge cap configured to detachably couple to the chamber proximal end. The cartridge can have a cartridge entry port and the cartridge entry port can be in fluid communication with the airflow entry port and is part of the airflow pathway.

The vaporizer can further comprise a magnetic connector and cartridge cap can comprise a metallic component configured to detachably couple to the magnetic connector. The cartridge can further comprise an airflow conduit at least partially within the cartridge chamber. The airflow conduit can have a conduit lumen and the conduit lumen can be part of the airflow pathway. At least part of the cartridge can be positioned within the frustoconical portion of the vaporizer when the cartridge is coupled to the vaporizer. In addition, at least a portion of the cartridge surrounding the heating chamber can be positioned outside of the frustoconical portion.

The cartridge can further comprise a cartridge base coupled to the chamber distal end. The cartridge base can have a base lumen within the cartridge base and the base lumen can be in fluid communication with the chamber interior and can be part of the airflow pathway. The cartridge base can comprise a base connector configured to connect to a mouthpiece attachment.

The vaporizer can further comprise a pressure sensing activation unit comprising a pressure sensor. At least a part of the pressure sensing activation unit can extend into a part of the airflow pathway. The pressure sensing activation unit can activate the vapor assembly when a change in air pressure is detected within the airflow pathway.

The vaporizer can further comprise a plurality of voltage indicator lights and a voltage selection button configured to set a voltage applied to terminals of the heating element. The plurality of voltage indicator lights can generate a unique light pattern associated with each of the voltages applied.

DETAILED DESCRIPTION

Figure 1A:
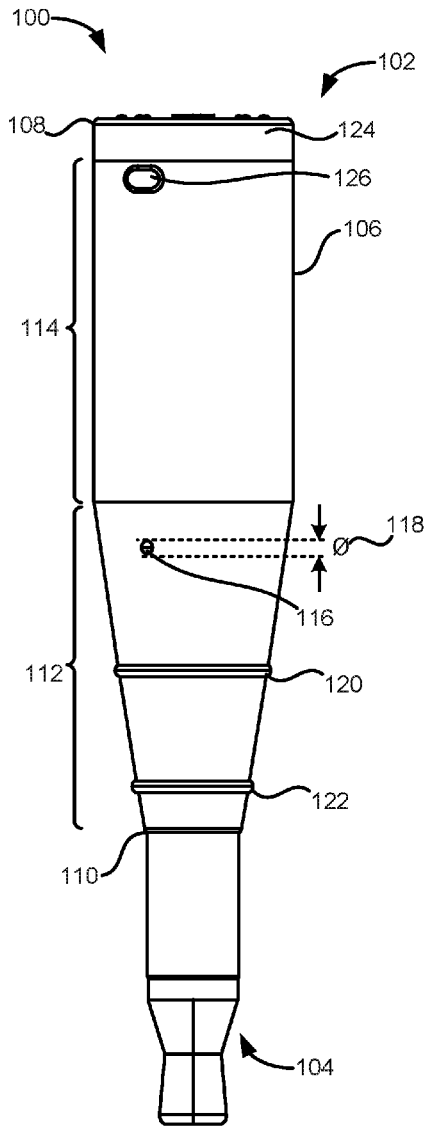
FIG. 1A illustrates one embodiment of a vaporizer assembly comprising a vaporizer and a cartridge coupled to the vaporizer.

FIG. 1A illustrates one embodiment of a vaporizer assembly 100 comprising a vaporizer 102 and a cartridge 104 coupled to the vaporizer 102. The vaporizer 102 can comprise a vaporizer housing 106 having a housing proximal end 108 and a housing distal end 110 opposite the housing proximal end 108. The vaporizer housing 106 can comprise a frustoconical portion 112 coupled to a battery housing 114. In the example embodiment shown in FIG. 1A, the battery housing 114 is shaped substantially as a cylinder or hollow tube. In other embodiments not shown but contemplated by this disclosure, the battery housing 114 can be shaped substantially as a cuboid, a square pyramid, a tetrahedron, a triangular or other polygonal prism, a trapezoidal prism, a cone, a frustoconic, an ellipsoid, an ovoid, or any combination thereof. In these and other embodiments, the battery housing 114 can be shaped to receive and house a battery such as a rechargeable battery. The battery housing 114 can be coupled to the frustoconical portion 112 by adhesives, welding, mechanical fasteners, an interference fit, or any combination thereof. In some embodiments, the battery housing 114 and the frustoconical portion 112 can be made of one molded piece instead of separate pieces. In these embodiments, the frustoconical portion 112 can be used to refer to a portion or section of the battery housing 114.

The frustoconical portion 112 can comprise at least one airflow entry port 116 positioned or defined along an exterior surface of the frustoconical portion 112. The at least one airflow entry port 116 can be an opening, aperture, cutout, or groove positioned or defined along the exterior surface of the vaporizer housing 106 facilitating the entry of air, gasses, or fluids into one or more interior chambers within the vaporizer housing 106. The entry of air, gasses, or fluids into the at least one airflow entry port 116 will be discussed in more detail in the following sections. One benefit of having the at least one airflow entry port 116 positioned or defined along the frustoconical portion 112 is to take advantage of the tapered exterior surface of this portion of the vaporizer 102 such that when the vaporizer assembly 100 is placed into a bowl or stem of a water pipe 800 (see FIG. 8), air entering the bowl or stem converges toward the at least one airflow entry port 116 and enters the at least one airflow entry port 116 in a manner conducive to delivering or carrying vapor through the vaporizer assembly 100.

It should be understood by one of ordinary skill in the art that although the at least one airflow entry port 116 is positioned or defined along a surface of the frustoconical portion 112, such a portion can also be shaped substantially as a conic, a tetrahedron, a square pyramid, a hexagonal or other polygonal pyramid, or any other three-dimensional structure having sloped or slanted exterior surfaces. Such other shapes and structures are within the scope of this disclosure.

As shown in the example embodiment of FIG. 1A, the at least one airflow entry port 116 can be a substantially circular entry port. In other embodiments not shown in the figures but contemplated by this disclosure, the at least one airflow entry port 116 can be shaped as a square or other polygon such as a pentagon, a hexagon, an octagon, etc., a triangle, a trapezoid, an oval, or any combination thereof.

In some embodiments, the vaporizer 102 can comprise only one airflow entry port 116. One benefit of having one airflow entry port 116 is to focus the ingress airflow through only one access point so as to enhance airflow into the interior of the vaporizer 102. In other embodiments, the vaporizer 102 can comprise multiple airflow entry ports 116 including between two and eight airflow entry ports 116. In these embodiments, pairs of airflow entry ports 116 can be positioned diametrically opposed to one another. In further embodiments, the airflow entry ports 116 can be positioned diametrically offset from one another. As will be discussed in the following sections, the at least one airflow entry port 116 can be the starting point of an airflow pathway 332 (see FIG. 3B) extending through the interior of the vaporizer assembly 100.

The at least one airflow entry port 116 can have an entry port diameter 118 when the at least one airflow entry port 116 is substantially shaped as a circle. The entry port diameter 118 can be between approximately 1.4 mm and 2.3 mm. In one embodiment, the entry port diameter 118 can be approximately 1.4 mm. In another example embodiment, the entry port diameter 118 can be between approximately 2.15 mm and 2.28 mm. In further embodiments where the vaporizer 102 comprises multiple airflow entry ports 116, the sum of the diameters of all of the airflow entry ports 116 can be between approximately 1.4 mm and 2.3 mm. In additional embodiments, the entry port diameter 118 or the sum of the diameters of all of the airflow entry ports 116 can be greater than 2.3 mm, such as between 2.3 mm and 5.0 mm.

The vaporizer 102 can also comprise at least one sealing or seal ring surrounding the vaporizer housing 106. For example, as shown in FIG. 1A, the vaporizer 102 can comprise a first seal ring 120 and a second seal ring 122 surrounding an exterior surface of the frustoconical portion 112. Although not shown in the figures, it is contemplated by this disclosure that the at least one seal ring (for example, any of the first seal ring 120, the second seal ring 122, or a combination thereof) can surround the exterior surface of the battery housing 114.

The vaporizer 102 can also have a vaporizer cap 124 and a voltage selection button 126. In one embodiment, the vaporizer cap 124 can be coupled to the vaporizer housing 106 and a cap surface of the vaporizer cap 124 can serve as the housing proximal end 108. In other embodiments, the vaporizer cap 124 can be part of the vaporizer housing 106. The voltage selection button 126 can protrude through one or more cutouts along the surface of the vaporizer housing 106. The vaporizer cap 124 and the voltage selection button 126 will be discussed in more detail in the following sections.

The frustoconical portion 112 can partially house the cartridge 104. As will be discussed in the following sections, the frustoconical portion 112 can have a cartridge receiving channel 318 (see FIG. 3B) extending from the housing distal end 110 into an interior of the frustoconical portion 112. The cartridge receiving channel 318 can have a channel opening at the housing distal end 110 and can extend, at least partially, into the interior of the frustoconical portion 112. As shown in the example embodiment of FIG. 1A, at least a portion of the cartridge 104 can be positioned within the cartridge receiving channel 318 when the cartridge 104 is coupled to the vaporizer 102 in an assembled state. In this and other embodiments, the remainder of the cartridge 104 can be positioned outside of the frustoconical portion 112 when the cartridge 104 is coupled to the vaporizer 102 in the assembled state.

Figure 1B:
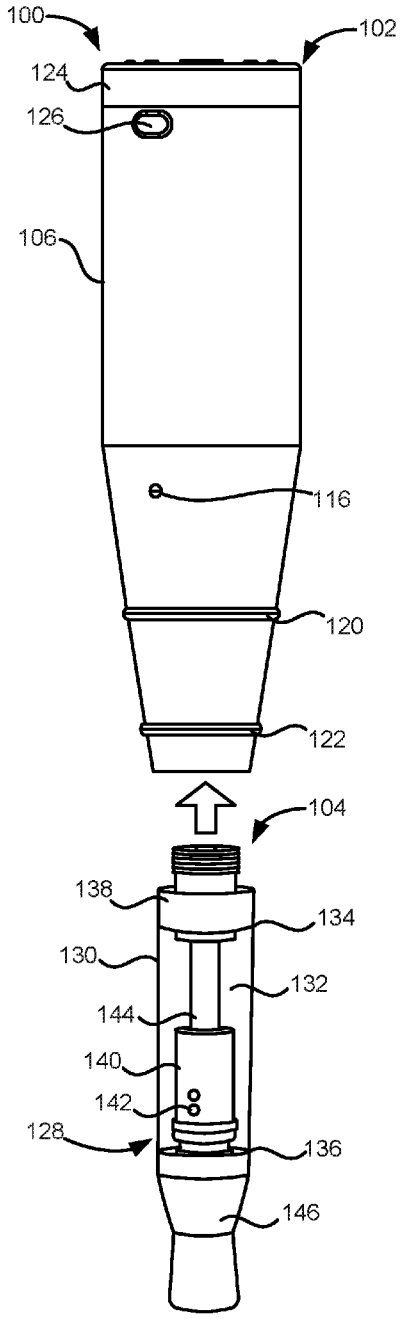
FIG. 1B illustrates one embodiment of a cartridge engaging with a vaporizer of the vaporizer assembly.

FIG. 1B illustrates one embodiment of the cartridge 104 engaging with an embodiment of a vaporizer 102. As shown in FIG. 1B, the cartridge 104 can be pushed into the cartridge receiving channel 318 (see FIG. 3B) of the vaporizer 102 to couple the cartridge 104 to the vaporizer 102.

Figure 5A:
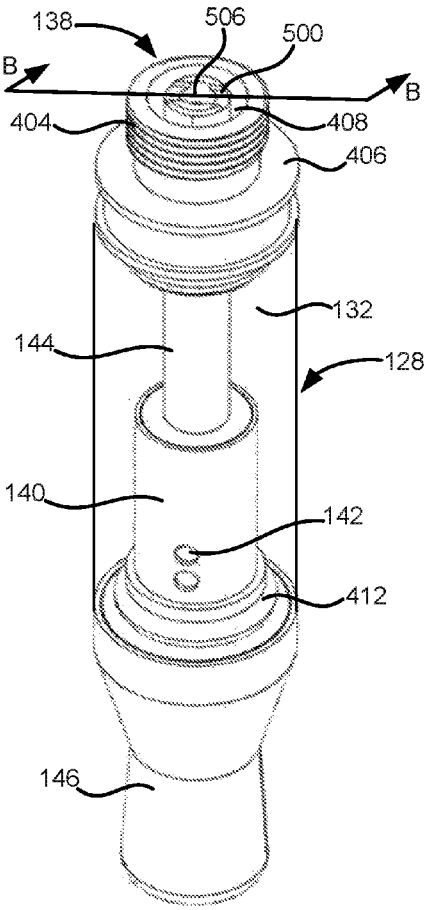
FIG. 5A is a perspective view of an embodiment of the cartridge.
Figure 5B:
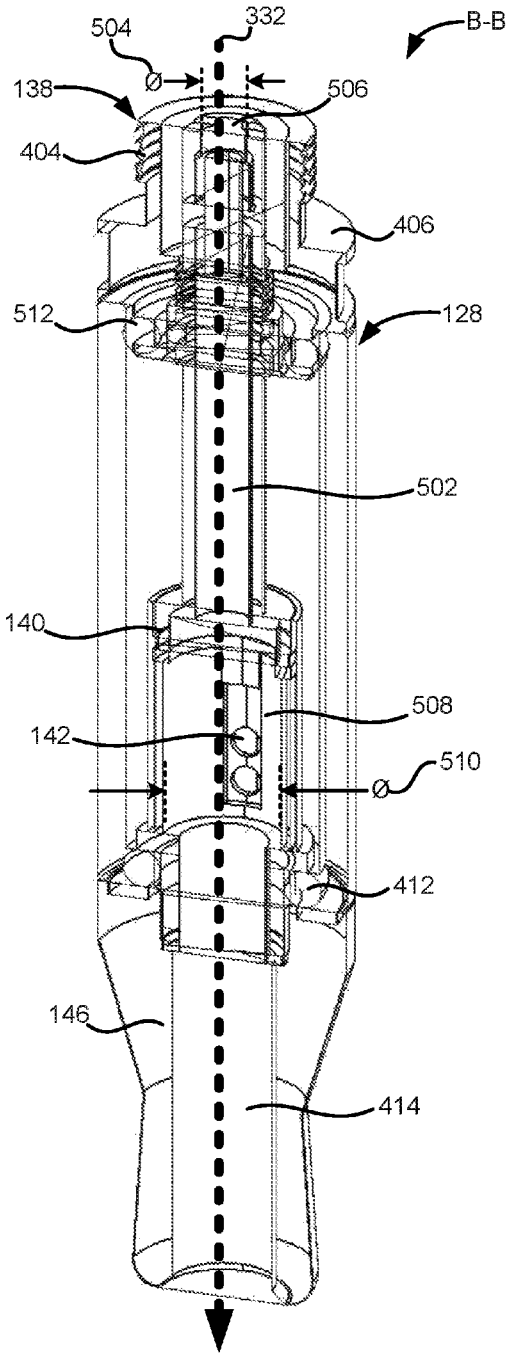
FIG. 5B is a cross-sectional view of the embodiment of the cartridge in FIG. 5A taken along line B-B.
Figure 5C:
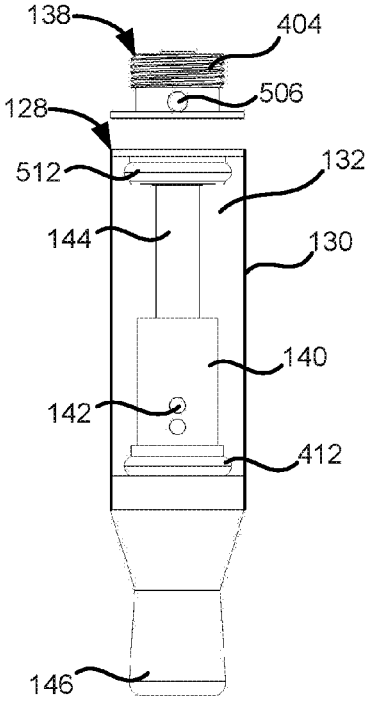
FIG. 5C is a side view of another embodiment of the cartridge.
Figure 5D:
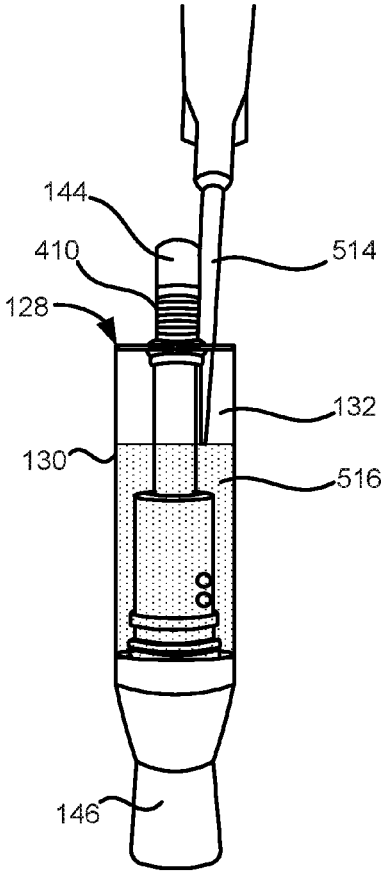
FIG. 5D is a perspective view of an embodiment of the cartridge with a cartridge cap removed.

The cartridge 104 can comprise a cartridge chamber 128 having a chamber wall 130 encapsulating or enclosing a chamber space 132 configured to hold a vaporizable liquid 516 (see FIG. 5D). The cartridge chamber 128 can have a chamber proximal end 134 and a chamber distal end 136 opposite the chamber proximal end 134.

In one embodiment, the cartridge chamber 128 can be shaped substantially as a cylinder. In other embodiments, the cartridge chamber 128 can be shaped as a frustoconic, a cone, a cuboid, a square pyramid, a tetrahedron, a triangular or other polygonal prism, a trapezoidal prism, an ellipsoid, an ovoid, or any combination thereof. The chamber wall 130 can be made of a transparent or see-through material such as glass (e.g., borosilicate glass, tempered soda-lime glass, etc.), a transparent polymeric material such as fiberglass, or a composite thereof.

The cartridge 104 can further comprise a cartridge cap 138 configured to detachably couple or to the chamber proximal end 134. For example, the cartridge cap 138 can detachably couple to the chamber proximal end 134 by being screwed onto a thread portion of the cartridge chamber 128 or extending from the cartridge chamber 128. In other embodiments, the cartridge cap 138 can detachably couple to the chamber proximal end 134 by an interference fit, clasps, clips, or other fasteners. The cartridge cap 138 can be detached or removed from the cartridge chamber 128 to allow the chamber space 132 to be filled with the vaporizable liquid 516.

The cartridge chamber 128 can have a heating chamber 140 positioned within the cartridge chamber 128. The heating chamber 140 can be shaped as a frustoconic, a cone, a cuboid, a square pyramid, a tetrahedron, a triangular or other polygonal prism, a trapezoidal prism, an ellipsoid, an ovoid, or any combination thereof. The heating chamber 140 can house a heating element 600 (an example of which is shown in FIG. 6B) used to heat or vaporize the vaporizable liquid 516 into a vapor. The heating chamber 140 can have at least one fluid entrance port 142 positioned or defined along a surface of the heating chamber 140. As shown in FIG. 1B, the heating chamber 140 can have two fluid entrance ports 142 positioned or defined along a surface of the heating chamber 140. The fluid entrance ports 142 are configured to facilitate entry of the vaporizable liquid 516 from the chamber space 132 into a chamber interior 508 (see FIG. 5B) within the heating chamber 140.

The cartridge 104 can also comprise an airflow conduit 144 in between the heating chamber 140 and the cartridge cap 138. In one embodiment, the airflow conduit 144 can connect the heating chamber 140 to the cartridge cap 138. The airflow conduit 144 can be positioned at least partially within the cartridge chamber 128. For example, the airflow conduit 144 can be partially surrounded by the chamber wall 130. The airflow conduit 144 can be an enclosed structure for facilitating airflow to the heating chamber 140. For example, the airflow conduit 144 can facilitate airflow from an opening along the cartridge cap 138 to the chamber interior 508 of the heating chamber 140. Although not shown in FIG. 1B, the airflow conduit 144 can have a conduit lumen 502 (see FIG. 5B) within the airflow conduit 144. The conduit lumen 502 can be in fluid communication with the chamber interior 508. The conduit lumen 502 can also be in fluid communication with the airflow entry port 116 when the cartridge 104 is coupled to the vaporizer 102. In some embodiments, the conduit lumen 502 can be in fluid communication with the airflow entry port 116 through chambers or lumens within the interior of the frustoconical portion 112 of the vaporizer 102. In other embodiments, the conduit lumen 502 can be in fluid communication with the airflow entry port 116 through chambers or lumens within the interior of the frustoconical portion 112 and an opening along the cartridge cap 138.

The cartridge 104 can also comprise a cartridge base 146. The cartridge base 146 can be coupled to the chamber distal end 136. Although not shown in FIG. 1B, the cartridge base 146 can have a base lumen 414 (see FIGS. 4 and 5B) within the cartridge base 146. The base lumen 414 can extend through the length of the cartridge base 146. The cartridge base 146 can be coupled to the cartridge chamber 128 and the heating chamber 140 in such a way that the base lumen 414 is in fluid communication with the chamber interior 508 and the outside environment (i.e., an environment external to the vaporizer assembly 100).

As will be discussed in the following sections, the at least one airflow entry port 116 can be the start of an airflow pathway 332 through the vaporizer assembly 100 comprising the opening on the cartridge cap 138, the conduit lumen 502, the chamber interior 508, and the base lumen 414. In certain embodiments, air flowing through the airflow pathway 332 can carry the vapor generated by or within the heating chamber 140 out of the vaporizer assembly 100.

As shown in FIGS. 1A and 1B, at least a portion of the cartridge 104 can be positioned outside of the vaporizer 102 when the cartridge 104 is detachably coupled to the vaporizer 102. In some embodiments, at least a portion of the cartridge 104 surrounding the heating chamber 140 can be positioned outside of the frustoconical portion 112 of the vaporizer 102 (e.g., outside of the cartridge receiving channel 318) when the cartridge 104 is coupled to the vaporizer 102.

Figure 2:
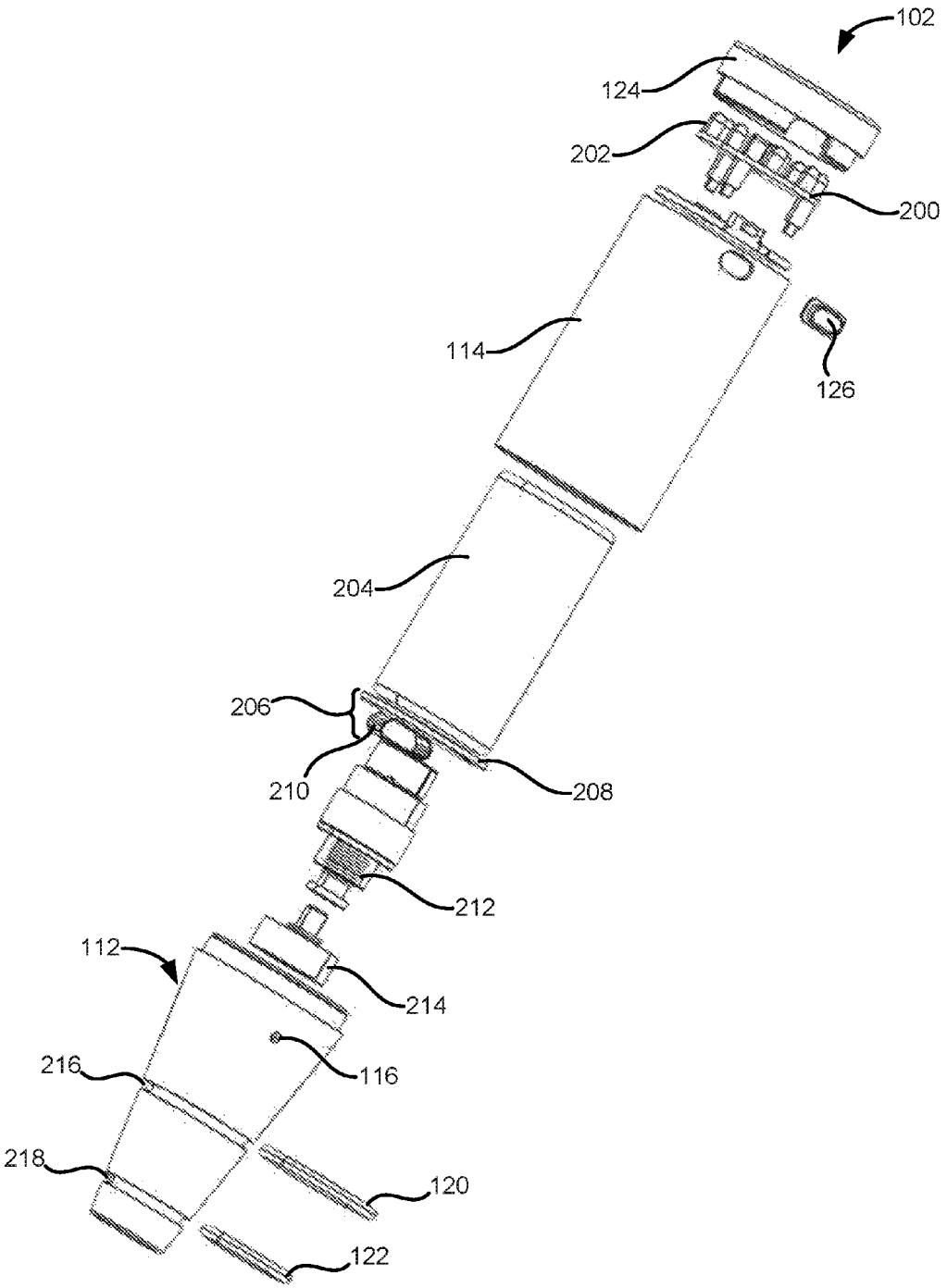
FIG. 2 illustrates an exploded view of one embodiment of a vaporizer.

FIG. 2 illustrates an exploded view of one embodiment of the vaporizer 102. The vaporizer 102 can comprise a voltage control unit 200 and a plurality of voltage indicator lights 202 housed, at least partially, within the vaporizer cap 124. The voltage control unit 200 and the voltage indicator lights 202 can both be electrically coupled to a printed circuit board. The voltage selection button 126 can also be electrically coupled to the printed circuit board. The voltage selection button 126 can be configured to direct the voltage control unit 200 to apply a specific voltage to terminals of the heating element 600 within the cartridge 104. The plurality of voltage indicator lights 202 can generate a unique light pattern associated with each of the voltages selected. The plurality of voltage indicator lights 202 can be color changing light-emitting diode (LED) lights. In some embodiments, the plurality of voltage indicator lights 202 can be organic light-emitting diodes (OLEDs) or active-matrix OLEDs (AMOLEDs). For example, the plurality of voltage indicator lights 202 can be eight LED lights arranged in a circular pattern and visible through cutouts along the vaporizer cap 124. Although not shown in the figures, it is contemplated by this disclosure that the vaporizer 102 can comprise an LED screen or a digital display screen displaying the voltage selected.

For example, the voltage control unit 200 can apply a voltage of 3.3V, 3.6 V, 3.9V, 4.2V, 4.5V, or 4.8V to terminals of the heating element 600. Higher voltages allow the heating element 600 to heat up faster and reach a higher vaporizing temperature within a predetermined time period. For example, applying a voltage of 3.3V to the terminals of the heating element 600 can heat up the heating element 600 to a temperature of approximately 264° C. in approximately 7-10 seconds. Also, for example, applying a voltage of 3.6V to the terminals of the heating element 600 can heat up the heating element 600 to a temperature of approximately 386° C. in approximately 7-10 seconds. As an additional example, applying a voltage of 3.9V to the terminals of the heating element 600 can heat up the heating element 600 to a temperature of approximately 425° C. in approximately 7-10 seconds. As a further example, applying a voltage of 4.2V to the terminals of the heating element 600 can heat up the heating element 600 to a temperature of approximately 678° C. in approximately 7-10 seconds. As yet another example, applying a voltage of 4.5V to the terminals of the heating element 600 can heat up the heating element 600 to a temperature of approximately 683° C. in approximately 7-10 seconds. As an additional example, applying a voltage of 4.8V to the terminals of the heating element 600 can heat up the heating element 600 to a temperature of approximately 710° C. in approximately 7-10 seconds. The temperature of the heating element 600 can determine the rate at which the vaporizable liquid 516 (e.g., the medicinal oil) is vaporized within the heating chamber 140 and affects the rate and amount of active ingredients released in vapor form or as a gas.

For example, a user can push the voltage selection button 126 to cycle or scroll through various voltages before deciding on a specific voltage. As the user pushes on the voltage selection button 126, the colors of the voltage indicator lights 202 can change to reflect the voltage currently selected. As an example, the voltage indicator lights 202 can be green when the voltage is set to 3.3V or be yellow when the voltage is set to 3.6V. Also, as an example, the voltage indicator lights 202 can be pink when the voltage is set to 3.7V or be blue when the voltage is set to 3.9V. In another example, the voltage indicator lights 202 can be red when the voltage is set to 4.2V or be violet when the voltage is set to 4.8V.

The cartridge cap 138 can be coupled to the battery housing 114. The battery housing 114 can house a rechargeable battery 204 and at least a part of the voltage selection button 126. In one embodiment, the rechargeable battery 204 can be a rechargeable lithium ion battery. For example, the rechargeable battery 204 can be a 1000 milli-Ampere-hour (mAh) lithium-ion battery. In other embodiments, the rechargeable battery 204 can be a nickel-metal hydride (NiMU) battery. The voltage selection button 126, the voltage control unit 200, and the voltage indicator lights 202 can be powered by the rechargeable battery 204.

The battery housing 114 can be coupled to the frustoconical portion 112 at an end opposite the vaporizer cap 124. In one embodiment, the battery housing 114, the frustoconical portion 112, and the vaporizer cap 124 can all be part of the vaporizer housing 106. In this and other embodiments, the battery housing 114, the frustoconical portion. 112, and the vaporizer cap 124 can be made or fabricated from or comprise a metal alloy such as an aluminum alloy. For example, the battery housing 114, the frustoconical portion 112, and the vaporizer cap 124 can be made from an aeronautic grade or high strength aluminum alloy. As a more specific example, the battery housing 114, the frustoconical portion 112, and the vaporizer cap 124 can be made from a 6120 aluminum alloy, a 6061 or 6063 aluminum alloy, a 5052 aluminum alloy, or any composites thereof. In other embodiments, the battery housing 114, the frustoconical portion 112, and the vaporizer cap 124 can be made or fabricated from or comprise a high strength polymer.

The frustoconical portion 112 can house an electronic assembly 206 powered by the rechargeable battery 204. The electronic assembly 206 can include a main printed circuit board (PCB) 208, a microcontroller connected to the main PCB 208, and a battery charging port 210 electrically coupled to the main PCB 208 and the rechargeable battery 204. The battery charging port 210 can be connected to a pass-through USB charger. Although not shown in the figures, it is contemplated by this disclosure that the vaporizer assembly 100 can comprise a solar charging unit rather than the battery charging port 210 to recharge the rechargeable battery 204.

The main PCB 208 and the microcontroller can be connected by wires or other conductors to terminals or electrodes of the heating element 600 within the cartridge 104. The microcontroller coupled to the main PCB 208 can also be configured to activate or power on the assembled vaporizer assembly 100.

The frustoconical portion 112 can also house a thread connector 212, a magnetic connector 214, and one or more electrodes. In one embodiment, the thread connector 212 can be a 510 thread connector. For example, the 510 thread connector can have approximately 10 threads along a 5.0 mm longitudinal length of the thread connector (or 0.5 threads per 1.0 mm in longitudinal length). In some embodiments, the thread connector 212 can have a diameter of between 9.0 mm and 10.0 mm.

The magnetic connector 214 can be positioned at an end of the cartridge receiving channel 318 within the frustoconical portion 112. As will be discussed in more detail in the following sections, the magnetic connector 214 can be adjacent to or surround the thread connector 212. The magnetic connector 214, the thread connector 212, or a combination thereof can be configured or designed as one-half of a complementary mechanism for detachably coupling the cartridge 104 to the vaporizer 102 when the cartridge 104 is inserted into the cartridge receiving channel 318.

The frustoconical portion 112 can also have at least one ring-groove to accommodate the seal rings. For example, as shown in the example embodiment of FIG. 2, the frustoconical portion 112 can have a first ring-groove 216 and a second ring-groove 218 along an exterior surface of the frustoconical portion 112. The first ring-groove 216 and the second ring-groove 218 can be concavities, divots, or furrows defined along the exterior surface of the frustoconical portion 112. For example, the first ring-groove 216 and the second ring-groove 218 can be substantially annular-shaped or toroidal shaped concavities, divots, or furrows defined along the exterior surface of the frustoconical portion 112. The seal rings, including the first seal ring 120 and the second seal ring 122, can be secured to the first ring-groove 216 and the second ring-groove 218, respectively, by an interference fit, adhesives, heat sealing, or a combination thereof.

Figure 3A:
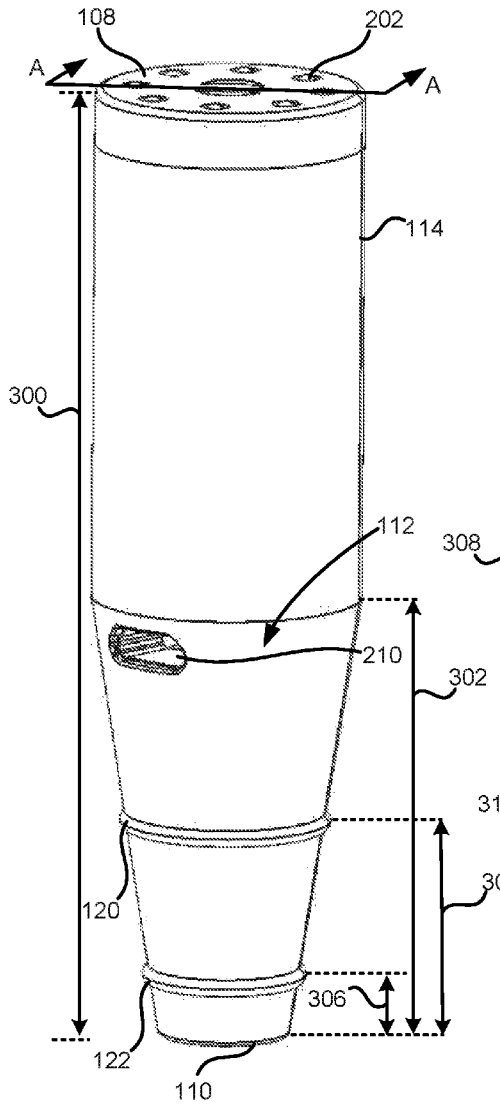
FIG. 3A is a perspective view of an embodiment of the vaporizer.

FIG. 3A illustrates that the vaporizer housing 106 can have a housing length 300. The housing length 300 can be the length from the housing proximal end 108 to the housing distal end 110. In some embodiments, the housing length 300 can be between approximately 70.0 mm and 85.0 mm. In one embodiment, the housing length 300 can be approximately 75.0 mm.

The frustoconical portion 112 can have a frustoconical length 302. The frustoconical length 302 can be the height of the distal portion of the vaporizer housing 106 shaped as an inverted frustoconic. In some embodiments, the frustoconical length 302 can be between approximately 30.0 mm and 40.0 mm. In one embodiment, the frustoconical length 302 can be approximately 35.5 mm.

FIG. 3A also illustrates that the first seal ring 120 can be positioned at a first ring distance 304 from the housing distal end 110. In some embodiments, the first ring distance 304 can be between approximately 15.0 mm and 17.0 mm. In one embodiment, the first ring distance 304 can be approximately 16.4 mm. The second seal ring 122 can be positioned at a second ring distance 306 from the housing distal end 110. The second seal ring 122 can be positioned closer to the housing distal end 110 than the first seal ring 120. In some embodiments, the second ring distance 306 can be between approximately 3.5 mm and 5.0 mm. In one embodiment, the second ring distance 306 can be approximately 4.2 mm.

Figure 3B:
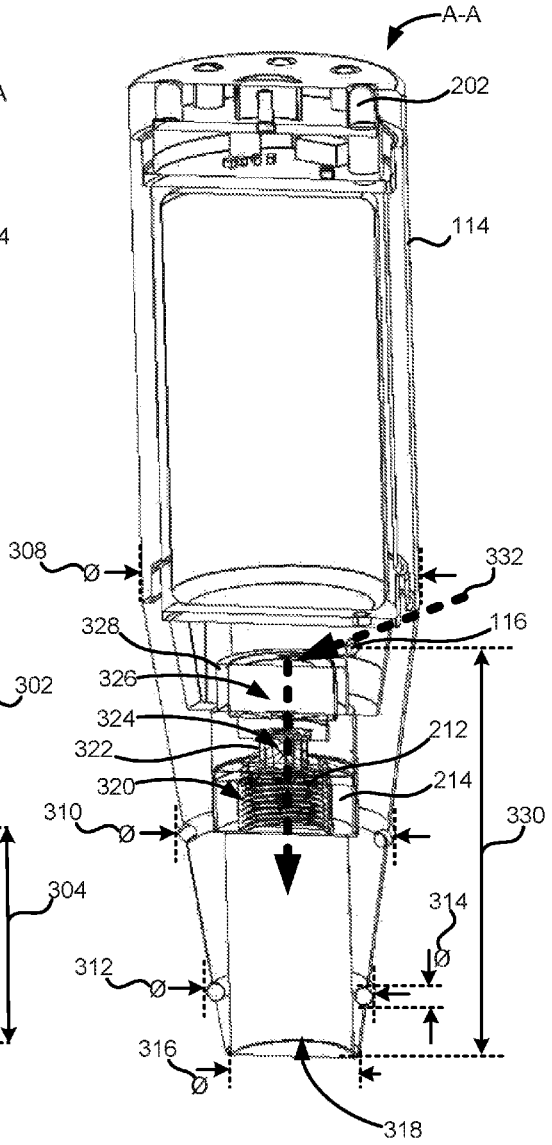
FIG. 3B is a cross-sectional view of the embodiment of the vaporizer shown in FIG. 3A taken along line A-A.

FIG. 3B is a cross-sectional view of the embodiment of the vaporizer 102 shown in FIG. 3A taken along line A-A. FIG. 3B illustrates that the battery housing 114 can have a battery housing diameter 308 when the battery housing 114 is shaped substantially as a cylinder. The battery housing diameter 308 can be between approximately 22.0 mm and 24.0 mm. In one embodiment, the battery housing diameter 308 can be approximately 22.98 mm. In some embodiments, the battery housing diameter 308 can be substantially equivalent to the largest diameter of the frustoconical portion 112.

FIG. 3B also illustrates that the first seal ring 120 can have a first seal ring diameter 310. In some embodiments, the first seal ring diameter 310 can be approximately between 17.0 mm and 19.0 mm. In one embodiment, the first seal ring diameter 310 can be approximately 18.0 mm. In addition, FIG. 3B illustrates that the second seal ring 122 can have a second seal ring diameter 312. In some embodiments, the second seal ring diameter 312 can be approximately between 13.0 mm and 15.0 mm. In one embodiment, the second seal ring diameter 312 can be approximately 14.0 mm. As shown in FIG. 3B, each of the first seal ring 120 and the second seal ring 122 can also have a ring cross-sectional diameter 314. In some embodiments, the ring cross-sectional diameter 314 can be approximately between 2.0 mm and 3.6 mm. In one embodiment, the ring cross-sectional diameter 314 can be approximately 3.5 mm.

The seal rings, including the first seal ring 120 and the second seal ring 122, can be made of a polymeric material or a copolymer. For example, the first seal ring 120 and the second seal ring 122 can be made of or comprise silicone rubber. As a more specific example, the first seal ring 120 and the second seal ring 122 can be made of or comprise methyl vinyl silicone rubber having polymeric segments represented by the chemical formula below:

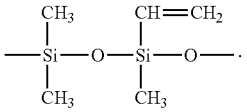

One advantage of making the first seal ring 120 or the second seal ring 122 out of a silicone rubber such as methyl vinyl silicone rubber is the high heat-resistance of the polymer and the ability for the polymer to withstand large temperature changes without sustaining harmful cracking or brittle fracture.

FIG. 3B illustrates that the housing distal end 110 can be measured by a distal end diameter 316. In some embodiments, the distal end diameter 316 can be between approximately 9.00 mm and 12.0 mm. In one embodiment, the distal end diameter 316 can be approximately 11.2 mm.

FIG. 3B also illustrates that a cartridge receiving channel 318 can extend from the housing distal end 110 into an interior of the frustoconical portion 112. As shown in the example embodiment of FIG. 3B, the cartridge receiving channel 318 can be a substantially cylindrical hollow or cavity. In other embodiments, the cartridge receiving channel 318 can be an empty space shaped as a conic or frustoconic, a cuboid, a tetrahedron, a square pyramid, a triangular prism, a polygonal prism, a barrel, or an ellipsoid.

The cartridge receiving channel 318 can terminate or end where the magnetic connector 214 or the thread connector 212 begin. As shown in FIG. 3B, the magnetic connector 214 be substantially annular shaped and can circumferentially surround or encircle the thread connector 212. The magnetic connector 214 can comprise or be made of permanent magnets, ferrite magnets, ceramic magnets, rare-earth magnets, or a combination thereof. As a more specific example, the magnetic connector 214 can comprise or be made of a neodymium iron boron (NdFeB or NIB) magnet, a samarium cobalt (SmCo) magnet, or an aluminum nickel cobalt (Alnico) magnet.

Figure 4:
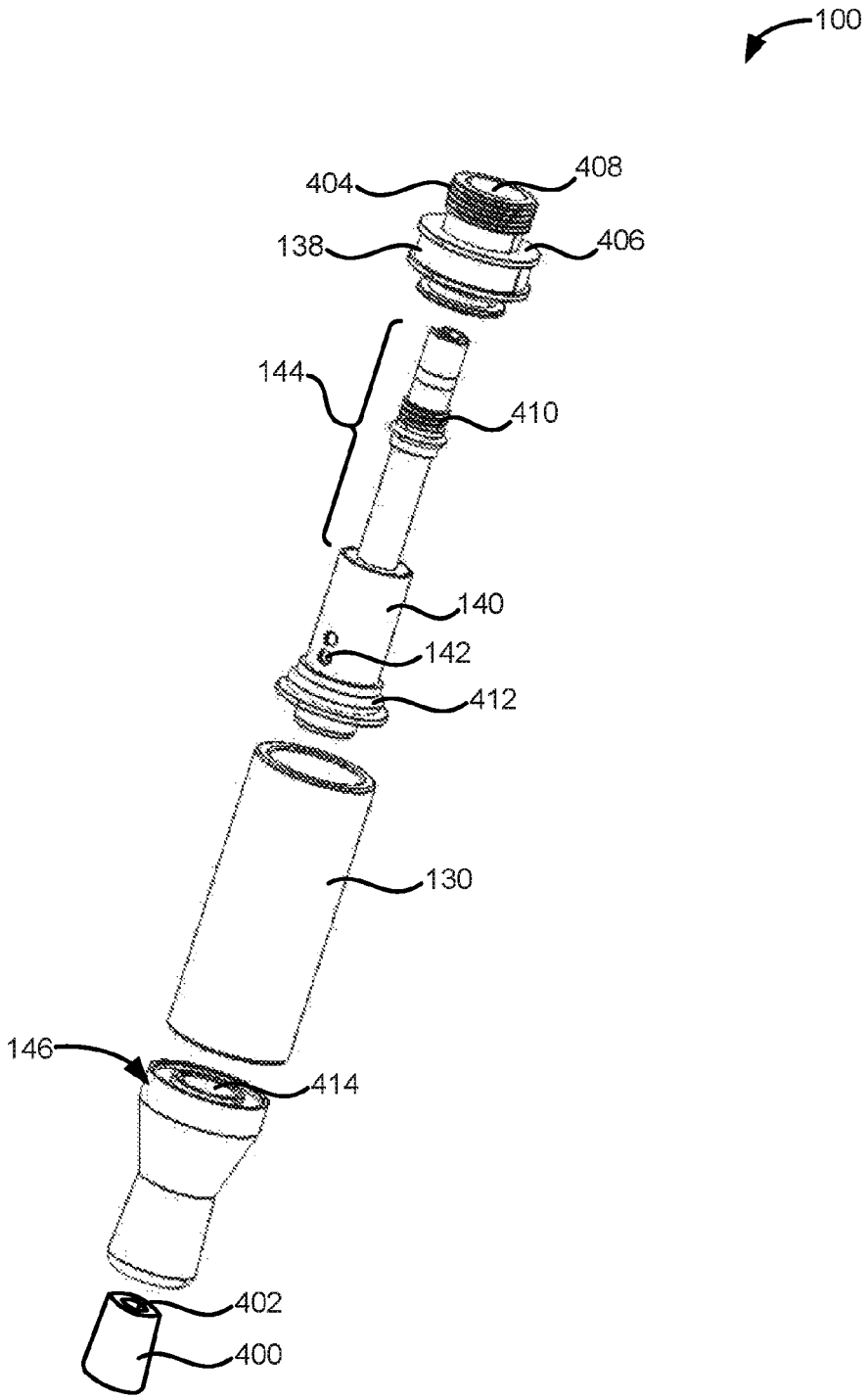
FIG. 4 illustrates an exploded view of one embodiment of a cartridge.

As previously discussed, the cartridge 104 can couple to the vaporizer 102 when the cartridge 104 is pushed into the cartridge receiving channel 318 and a portion of the cartridge cap 138 is either screwed into the thread connector 212 or a metallic component 406 (as shown in FIG. 4) along the cartridge cap 138 magnetically attaches to the magnetic connector 214. When the cartridge cap 138 is magnetically attached to the magnetic connector 214 rather than being screwed into the threads of the thread connector 212, the interior of the thread connector 212 can define a thread lumen 320 (i.e., a cavity or open channel through the thread connector 212).

As shown in FIG. 3B, the frustoconical portion 112 can also house a narrowing chamber 322 having a narrowing lumen 324, and an entry chamber 326 having an entry lumen 328. The narrowing chamber 322 can be coupled or adjacent to the thread connector 212. The narrowing chamber 322 can be positioned in between the thread connector 212 and the entry chamber 326. The thread lumen 320, the narrowing lumen 324, and the entry lumen 328 can be in fluid communication with the cartridge receiving channel 318 when the cartridge 104 is not coupled to the vaporizer 102. The narrowing lumen 324 can have a smaller diameter or lumen space than the entry lumen 328 and the thread lumen 320. Although FIG. 3B shows the frustoconical portion 112 comprising the magnetic connector 214, the thread connector 212, the narrowing chamber 322 and the entry chamber 326, it is contemplated by this disclosure that one or several of such chambers or connectors could be removed from the frustoconical portion 112 in alternative embodiments of the vaporizer 102.

FIG. 3B also illustrates that the airflow entry port 116 can extend from the exterior surface into the interior of the frustoconical portion 112 and be positioned near the entry chamber 326. The airflow entry port 116 can be positioned at a distance from the housing distal end 110 of the vaporizer housing 106. This distance can be referred to as the airflow entry distance 330. In some embodiments, the airflow entry distance 330 can be between approximately 28.0 mm to 32.0 mm. In one embodiment, the airflow entry distance 330 can be approximately 30.0 mm.

As shown in FIG. 3B, the airflow entry port 116 can be in fluid communication with the cartridge receiving channel 318 when the cartridge 104 is not placed within the cartridge receiving channel 318. The airflow entry port 116 can be in fluid communication with the cartridge receiving channel 318 through the entry lumen 328, the narrowing lumen 324, the thread lumen 320, or a combination thereof. That is, the airflow entry port 116 can be in fluid communication with any or all of the entry lumen 328, the narrowing lumen 324, the thread lumen 320, and the cartridge receiving channel 318.

The airflow entry port 116 can be the start of an airflow pathway 332 extending through the interior of the vaporizer assembly 100. In one embodiment, the airflow pathway 332 can include at least part of the airflow entry port 116, the entry lumen 328, the narrowing lumen 324, and the thread lumen 320, and the cartridge receiving channel 318. For example, air can enter through the airflow entry port 116 and follow the airflow pathway 332 into the entry lumen 328, the narrowing lumen 324, and the thread lumen 320 on its way into the cartridge 104. It should be understood by one of ordinary skill in the art that references to the entry lumen 328, the narrowing lumen 324, or the thread lumen 320 can also refer to segments or portions of a singular lumen or channel through the vaporizer 102 or segments or portions of overlapping or shared lumens or channels through the vaporizer 102.

FIG. 4 illustrates that the cartridge 104 can comprise the cartridge cap 138, the airflow conduit 144, the heating chamber 140, the chamber wall 130, and the cartridge base 146. In the embodiment shown in FIG. 4, the cartridge base 146 can be configured to connect to a mouthpiece attachment 400. The mouthpiece attachment 400 can be connected or attached to the cartridge base 146 via a threaded connection, an interference fit, a magnetic connection, or a combination thereof. For example, the mouthpiece attachment 400 can be inserted into a portion of a base lumen 414 (see also FIG. 5B). The mouthpiece attachment 400 can have a mouthpiece lumen 402. The mouthpiece lumen 402 can have a lumen diameter between 2.0 mm and 5.0 mm. The mouthpiece lumen 402 can be placed in fluid communication with the base lumen 414 and a user can insert the mouthpiece attachment 400 into the user's mouth and cause air to be drawn in through the vaporizer assembly 100 by inhaling through the mouthpiece attachment 400.

The cartridge cap 138 can comprise a thread connection 404, a metallic component 406, or a combination thereof. The thread connection 404 can be a complementary thread to the thread connector 212 within the frustoconical portion 112 of the vaporizer 102. For example, the thread connection 404 on the cartridge cap 138 can be a male 510 thread and the thread connector 212 in the vaporizer 102 can be a female 510 thread.

The cartridge cap 138 can also comprise a metallic component 406. The metallic component 406 can be any type of metal having ferromagnetic properties. For example, the metallic component 406 can comprise iron, nickel, cobalt, rare earth metals, or any combination or alloys thereof. The metallic component 406 can be positioned along a top or proximal surface of the cartridge cap 138. For example, the metallic component 406 can be a metallic disk or ring positioned at the top or proximal surface of the cartridge cap 138.

Although FIG. 4 depicts the cartridge 104 having both a thread connection 404 and a metallic component 406, other embodiments of the cartridge 104 can have only the thread connection 404 or only the metallic component 406 depending on the type of connector within the frustoconical portion 112 of the vaporizer 102.

FIG. 4 also illustrates that the airflow conduit 144 can be coupled to the heating chamber 140. The chamber wall 130 of the cartridge chamber 128 can completely surround the heating chamber 140 when the cartridge 104 is in the assembled state. At least a part of the airflow conduit 144 can extend out of the cartridge chamber 128 (i.e., extend longitudinally past the chamber wall 130) when the cartridge 104 is in the assembled state. The cartridge cap 138 can be detachably coupled to a proximal end of the airflow conduit 144. As shown in FIG. 4, the airflow conduit 144 can have a threaded portion 410 near the proximal end of the airflow conduit 144 and the cartridge cap 138 can have a complementary threaded portion within the cartridge cap 138. For example, the cartridge cap 138 can have a cap lumen 408 and a portion of the cap lumen 408 can have threads defined along the cap lumen 408.

The heating chamber 140 can have at least one fluid entrance port 142 defined along a surface of the heating chamber 140. As shown in FIG. 4, the heating chamber 140 can have two fluid entrance ports 142 defined along the surface of the heating chamber 140. The fluid entrance ports 142 can facilitate the entry of the vaporizable liquid 516 from the chamber space 132 into an interior of the heating chamber 140. Each of the fluid entrance ports 142 can have a port diameter when the fluid entrance port 142 is substantially shaped as a circle. In some embodiments, the port diameter can be between approximately 1.3 mm and 1.5 mm. In one embodiment, the port diameter can be approximately 1.4 mm.

The heating chamber 140, the airflow conduit 144, and the cartridge cap 138 can be fabricated from or comprise a metal or metal alloy, a polymeric material, or a composite thereof. For example, in one embodiment, the heating chamber 140, the airflow conduit 144, and portions of the cartridge cap 138 can be fabricated from or comprise stainless steel. In this and other embodiments, the chamber wall 130 can be fabricated from or comprise a transparent or see-through material such as glass (e.g., borosilicate glass, tempered soda-lime glass, etc.). For example, the chamber wall 130 can be made of Pyrex® glass. In other embodiments, the chamber wall 130 can be made of a transparent polymeric material such as fiberglass or another high-strength transparent polymer.

As shown in FIG. 4, a distal interior seal ring 412 can surround or be positioned near a distal end of the heating chamber 140. The distal interior seal ring 412 can be made of a silicone rubber. For example, the distal interior seal ring 412 can comprise or be made of methyl vinyl silicone rubber. The distal interior seal ring 412 can prevent the vaporizable liquid 516 within the cartridge chamber 128 from leaking out of the cartridge chamber 128.

FIG. 4 also illustrates that the cartridge base 146 can have a base lumen 414. The base lumen 414 can be in fluid communication with an interior of the heating chamber 140 when the cartridge base 146 is coupled to the cartridge chamber 128. The cartridge base 146 can be made of or comprise a metal or metal alloy covered by chromium plating.

FIG. 5A illustrates that the heating chamber 140 and a portion of the airflow conduit 144 can be positioned within the cartridge chamber 128 and encircled by the chamber wall 130 when the cartridge 104 is in the assembled state. In some embodiments, the distal interior seal ring 412 can also be coupled to a distal end of the heating chamber 140 within the cartridge chamber 128. A user can fill the chamber space 132 within the cartridge chamber 128 with a vaporizable liquid 516 (see, for example, FIG. 5D). The chamber space 132 can be the free space within the cartridge chamber 128 not occupied by the heating chamber 140 and the portion of the airflow conduit 144. In some embodiments, the chamber space 132 can hold between approximately 450 mL and 750 mL of the vaporizable liquid 516. In one embodiment, the chamber space 132 can hold approximately 500 mL of the vaporizable liquid 516.

FIG. 5A illustrates that the airflow conduit 144 can have a conduit proximal end 500. The conduit proximal end 500 can be the end of the airflow conduit 144 not attached or connected to the heating chamber 140. As seen in the example embodiment of FIG. 5A, the conduit proximal end 500 can extend through at least part of the cap lumen 408 of the cartridge cap 138. The airflow conduit 144 can have a conduit length. The conduit length can be the length of the airflow conduit 144 extending from the distal end of the airflow conduit 144 (the end connected to the heating chamber 140) to the conduit proximal end 500. In some embodiments, the conduit length can be between approximately 10.0 mm and 15.0 mm. In one embodiment, the conduit length can be approximately 13.0 mm.

Although the airflow conduit 144 is shown as one connected piece or structure in FIGS. 4 and 5A, it should be understood by one of ordinary skill in the art that the airflow conduit 144 can be composed of multiple sections, segments, or pieces.

In addition, although FIG. 5A illustrates the cartridge 104 having both the thread connection 404 and the metallic component 406, it is contemplated by this disclosure that alternative embodiments of the cartridge 104 can have only the thread connection 404 without the metallic component 406 or only the metallic component 406 without the thread connection 404. Whether the cartridge 104 has the metallic component 406, the thread connection 404, or a combination thereof is determined by whether the vaporizer 102 has the thread connector 212, the magnetic connector 214, or a combination thereof, respectively.

FIG. 5B is a cross-sectional view of the embodiment of the cartridge 104 in FIG. 5A taken along line B-B. FIG. 5B illustrates that the airflow conduit 144 can have a conduit lumen 502. The conduit lumen 502 can be a substantially cylindrical channel or hollow space within the airflow conduit 144. The conduit lumen 502 can have a conduit lumen diameter 504. In some embodiments, the conduit lumen diameter 504 can be between approximately 1.2 mm and 2.0 mm. In other embodiments, the conduit lumen diameter 504 can be between approximately 1.4 mm and 1.5 mm. In one example embodiment, the conduit lumen diameter 504 can be approximately 1.4 mm. In yet additional embodiments, the conduit lumen diameter 504 can be between approximately 1.7 mm and 1.9 mm.

As shown in FIGS. 5A and 5B, when the conduit lumen 502 extends to the conduit proximal end 500, the opening to the conduit lumen 502 can be referred to as the cartridge entry port 506. In other embodiments discussed in the sections that follow, the cartridge entry port 506 can refer to a port opening or slot along a lateral or radial surface of the cartridge cap 138 (see FIG. 5C).

FIG. 5B also illustrates that the heating chamber 140 can have a chamber interior 508. The chamber interior 508 can be a space or opening within the heating chamber 140. The chamber interior 508 can have a chamber diameter 510. In some embodiments, the chamber diameter 510 can be between approximately 5.5 mm and 7.5 mm. In one embodiment, the chamber diameter 510 can be between approximately 5.5 mm and 6.0 mm.

The conduit lumen 502 of the airflow conduit 144 can be in fluid communication with the chamber interior 508. In addition, the cartridge entry port 506 can be in fluid communication with the conduit lumen 502 and the chamber interior 508. As shown in FIG. 5B, the chamber interior 508 can also be in fluid communication with the base lumen 414, which in turn, is in fluid communication with an outside environment or an environment external to the vaporizer assembly 100.

FIG. 5B also illustrates that the airflow pathway 332 of FIG. 3B can include the cartridge entry port 506, the conduit lumen 502, the chamber interior 508, and the base lumen 414 when the cartridge 104 is detachably coupled to the vaporizer 102. For example, the cartridge 104 can have the thread connection 404 and the thread connection 404 can be screwed into the thread connector 212 within the frustoconical portion 112 of the vaporizer 102. In this embodiment, air can flow directly from the narrowing lumen 324 to the conduit lumen 502 and the narrowing lumen 324 and conduit lumen 502 can both be part of the airflow pathway 332. In another embodiment, the air can flow from the narrowing lumen 324 to the thread lumen 320 and then through a cartridge entry port 506 positioned along a surface of the cartridge cap 138 into the conduit lumen 502. In this embodiment, the airflow pathway 332 along this connection can comprise the narrowing lumen 324, the thread lumen 320, the cartridge entry port 506 and the conduit lumen 502. In yet another embodiment, the cartridge cap 138 can have only the metallic component 406 without the thread connection 404 and the cartridge 104 can detachably couple to the vaporizer 102 via a magnetic connector 214 within the frustoconical portion 112. In this embodiment, the airflow pathway 332 along this connection can comprise the narrowing lumen 324, the thread lumen 320, and the conduit lumen 502 (where the opening of the conduit lumen 502 is referred to as the cartridge entry port 506).

FIG. 5B also illustrates that the cartridge cap 138 can comprise a proximal interior seal ring 512. The proximal interior seal ring 512 can be positioned at a distal end of the cartridge cap 138. The proximal interior seal ring 512 can be configured to prevent leakage of the vaporizable liquid 516 out of the proximal end of the cartridge chamber 128 when the cartridge cap 138 is coupled to the cartridge chamber 128. Having the proximal interior seal ring 512 at this end of the cartridge chamber 128 allows the cartridge 104 to be turned upside down (i.e., where the chamber proximal end 134 is proximal to or above the housing distal end 110 of the vaporizer 102). This allows the vaporizer assembly 100 to be used as a portable handheld vaporizer or vaporizer pen when a mouthpiece attachment 400 is coupled to the cartridge base 146 (see FIG. 9).

FIG. 5C is a side view of another embodiment of the cartridge 104 having a cartridge entry port 506 defined along the cartridge cap 138. For example, the cartridge entry port 506 can be substantially circular-shaped. In some embodiments, the cartridge entry port 506 can have a port diameter of between approximately 1.3 mm and 1.5 mm. In one embodiment, the cartridge entry port 506 can have a port diameter of approximately 1.4 mm. Although the cartridge entry port 506 is shown as distal to the thread connection 404 in FIG. 5C, it is also contemplated by this disclosure that the cartridge entry port 506 can be defined along a lateral or side surface of the thread connection 404. In other embodiments, the cartridge entry port 506 can be shaped as a slot, a triangle, a square, a rectangle, an oval, an X-pattern, or a combination thereof. In all such embodiments, the cartridge entry port 506 can be in fluid communication with the conduit lumen 502 of the airflow conduit 144. For example, when the cartridge 104 of FIG. 5C is detachably coupled to the vaporizer 102, air flowing through the airflow pathway 332 can flow from the airflow entry port 116 through the entry chamber 326 into the entry lumen 328, the narrowing lumen 324, and the thread lumen 320 and enter the conduit lumen 502 through the cartridge entry port 506 along the cartridge cap 138. In this embodiment, the conduit proximal end 500 of the airflow conduit 144 can be closed or sealed. Alternatively, when the cartridge 104 of FIG. 5A is detachably coupled to the vaporizer 102, air flowing through the airflow pathway 332 can flow from the airflow entry port 116 through the entry chamber 326 into the entry lumen 328 and the narrowing lumen 324 and enter the conduit lumen 502 through the cartridge entry port 506 defined at the conduit proximal end 500.

FIG. 5D is a perspective view of an embodiment of the cartridge 104 with the cartridge cap 138 removed. For example, the cartridge cap 138 can be removed by unscrewing the cartridge cap 138 from the threaded portion 410 of the airflow conduit 144. With the cartridge cap 138 removed, the chamber space 132 of the cartridge chamber 128 can be filled with a vaporizable liquid 516. As shown in FIG. 5D, the vaporizable liquid 516 can be injected into the chamber space 132 using a syringe 514. In other embodiments, the vaporizable liquid 516 can be introduced into the chamber space 132 using a dropper. As previously discussed, the chamber space 132 can be filled with up to 750 mL of the vaporizable liquid 516. In other embodiments, the chamber space 132 can be filled with up to 500 mL of the vaporizable liquid 516.

The vaporizable liquid 516 can include liquid nicotine, liquid nicotine oil blends comprising propylene glycol and vegetable glycerin, medicinal oils or tinctures, medicinal hashish oils, essential oils, aromatherapy oils, cannabidiol (CBD) oils or tinctures, CBD hemp oil, clear concentrates, $CO_2$ oils, butane hash oil (BHO), or any combination thereof.

One benefit of the cartridge 104 having the removable cartridge cap 138 is being able to refill the cartridge 104 and allowing a user to re-use the cartridge 104 and vaporize different kinds of vaporizable liquids with the vaporizer assembly 100. Another benefit of the cartridge 104 having the removable cartridge cap 138 is providing a user the ability to clean the cartridge chamber 128 and the chamber space 132 after each use.

In another embodiment, the cartridge chamber 128 can be pre-filled with the vaporizable liquid 516. In this and other embodiments, the cartridge cap 138 can be fixedly attached or coupled to the rest of the cartridge 104. In these embodiments, the cartridge 104 can be considered a single-use or disposable cartridge.

Figure 6A:
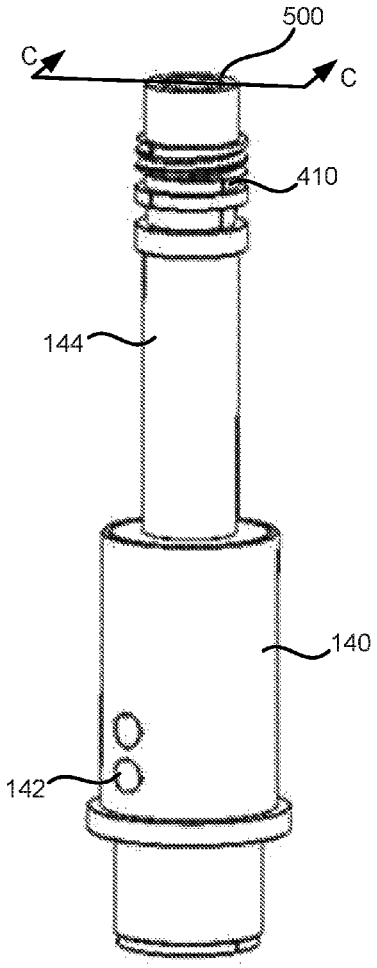
FIG. 6A is a perspective view of an embodiment of a heating chamber and airflow conduit.
Figure 6B:
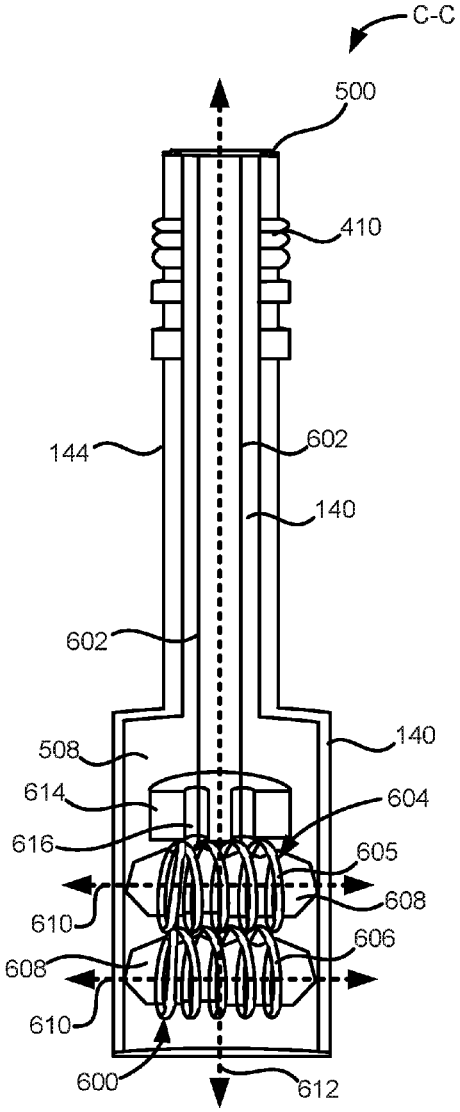
FIG. 6B is a cross-sectional view of the embodiment of the heating chamber and the airflow conduit in FIG. 6A taken along line C-C.

FIG. 6A is a perspective view of an embodiment of a heating chamber 140 and airflow conduit 144 removed from the cartridge chamber 128. FIG. 6B is a cross-sectional view of the embodiment of the heating chamber 140 and the airflow conduit 144 in FIG. 6A taken along line C-C. FIG. 6B illustrates that the chamber interior 508 can house a heating element 600. The heating element 600 can be configured heat and vaporize the vaporizable liquid 516 (e.g., see FIG. 5D) flowing into the chamber interior 508 from the chamber space 132 through the fluid entrance ports 142.

The heating element 600 can be connected to the electronic assembly 206 including the main PCB 208 by one or more wires 602 or other conductive connections. For example, the wires 602 can be electrically coupled to terminals on the heating element 600.

In the example embodiment shown in FIG. 6B, the heating element 600 can comprise at least two heating coils 604 including a first heating coil 605 and a second heating coil 606. The heating coils 604 can be resistive heating coils. In one embodiment, the heating coils 604 can be resistive heating coils comprising iron-chromium-aluminum alloy. For example, the heating coils 604 can be Kanthal® iron-chromium-aluminum alloy coils. In one example embodiment, each of the heating coils 604 can have a resistance of 1.8 Ohms.

Also, for example, each of the heating coils 604 including the first heating coil 605 and the second heating coil 606 can have a coil diameter and a coil length. In some embodiments, the coil diameter can be between approximately 4.5 mm and 6.0 mm. In these and other embodiments, the coil length can be between approximately 5.0 mm and 6.5 mm.

Each of the heating coils 604 including the first heating coil 605 and the second heating coil 606 can be wound around a wicking material 608. The wicking material 608 can be a heat-resistant material for soaking up or absorbing the vaporizable liquid 516. For example, the wicking material 608 can be a fiberglass wicking material. The wicking material 608 can facilitate the entry of the vaporizable liquid 516 into the chamber interior 508 and retain or hold the vaporizable liquid 516 closer to the heating coils 604.

FIG. 6B also illustrates that each of the heating coils 604 can have a coil longitudinal axis 610 and the heating chamber 140 can have a chamber longitudinal axis 612. The heating coils 604 can be positioned substantially horizontal within the chamber interior 508 such that the coil longitudinal axis 610 of each of the heating coils 604 is substantially perpendicular to the chamber longitudinal axis 612 of the heating chamber 140.

The second heating coil 606 can be positioned distal to the first heating coil 605. In addition, the coil longitudinal axis 610 of the second heating coil 606 can be substantially parallel to the coil longitudinal axis 610 of the first heating coil 605 when the first heating coil 605 and the second heating coil 606 are positioned within the chamber interior 508.

FIG. 6B also illustrates that the heating chamber 140 can house an insulator 614 within the chamber interior 508. The insulator 614 can be positioned proximal to the heating element 600. For example, the insulator 614 can be positioned proximal to the first heating coil 605. In one example embodiment, the insulator 614 can be a ceramic insulator. The insulator 614 can be shaped substantially as a circular cap. In one embodiment, the insulator 614 can have a plurality of holes or airflow channels 616 extending through the insulator 614. The airflow channels 616 can allow air to pass through the body of the insulator 614 and into the rest of the chamber interior 508. The airflow channels 616 can also allow the wires 602 to pass through the insulator 614 and connect to the heating coils 604. The insulator 614 can secure the heating coils 604 within the chamber interior 508 and insulate the heating coils 604 from the walls of the heating chamber 140. The insulator 614 can also serve as a bowl or dish to catch or prevent the vaporizable liquid 516 to leak into the airflow conduit 144 when the vaporizer assembly 100 is used as a handheld vaporizer or vaporizer pen.

The heating element 600 can be electrically connected by the wires 602 to the electronic assembly 206 when the cartridge 104 is coupled to the vaporizer 102. As previously discussed, the electronic assembly 206, including the main PCB 208, can be electrically connected to the voltage control unit 200 which can be controlled by the voltage selection button 126 on the vaporizer 102. The voltage selection button 126 can be configured to direct the voltage control unit 200 to apply a specific voltage to terminals of the heating element 600 within the cartridge 104 to raise the temperature within the heating chamber 140. A plurality of voltage indicator lights 202 on the vaporizer 102 can also generate a unique light pattern associated with each of the voltages selected.

For example, the voltage control unit 200 can apply a voltage of 3.3 V, 3.6 V, 3.9V, 4.2V, 4.5V, or 4.8V to terminals of the heating element 600 (e.g., the heating coils 604). Higher voltages allow the heating element 600 (e.g., the heating coils 604) to heat up faster and reach a higher vaporizing temperature within a predetermined time period. For example, applying a voltage of 3.3V to the terminals of the heating element 600 can heat up the heating element 600 to a temperature of approximately 264° C. in approximately 7-10 seconds. Also, for example, applying a voltage of 3.6V to the terminals of the heating element 600 can heat up the heating element 600 to a temperature of approximately 386° C. in approximately 7-10 seconds. As an additional example, applying a voltage of 3.9V to the terminals of the heating element 600 can heat up the heating element 600 to a temperature of approximately 425° C. in approximately 7-10 seconds. As a further example, applying a voltage of 4.2V to the terminals of the heating element 600 can heat up the heating element 600 to a temperature of approximately 678° C. in approximately 7-10 seconds. As yet another example, applying a voltage of 4.5V to the terminals of the heating element 600 can heat up the heating element 600 to a temperature of approximately 683° C. in approximately 7-10 seconds. As an additional example, applying a voltage of 4.8V to the terminals of the heating element 600 can heat up the heating element 600 to a temperature of approximately 710° C. in approximately 7-10 seconds. The temperature of the heating element 600 can determine the rate at which the vaporizable liquid 516 (e.g., the medicinal oil) is vaporized within the heating chamber 140 and affects the rate and amount of active ingredients released in vapor form or as a gas.

Figure 7A:
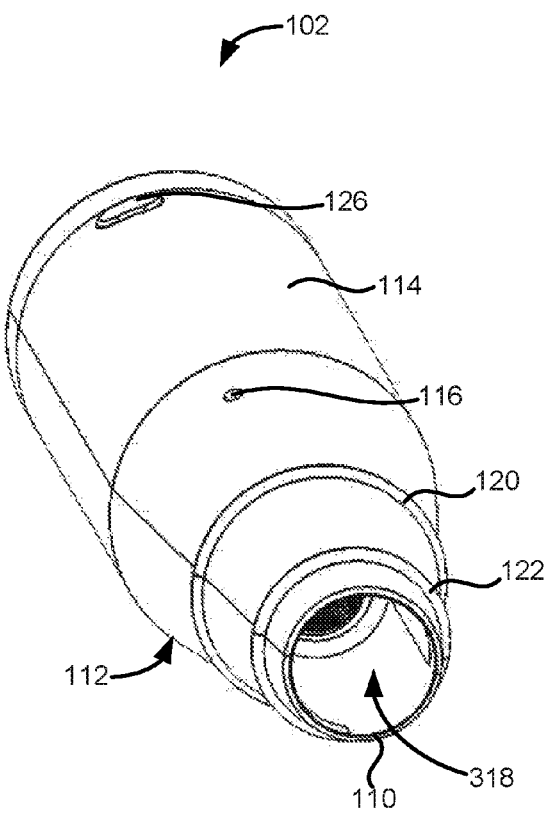
FIG. 7A is a bottom perspective view of an embodiment of the vaporizer.

FIG. 7A is a bottom perspective view of an embodiment of the vaporizer 102. FIG. 7A illustrates that the frustoconical portion 112 can have a cartridge receiving channel 318 extending from the housing distal end 110 into an interior of the frustoconical portion 112. In one embodiment, the cartridge receiving channel 318 can be substantially cylindrical. In this embodiment, the cartridge receiving channel 318 can have a substantially circular channel opening at the housing distal end 110. The cartridge receiving channel 318 can extend, at least partially, into the interior of the frustoconical portion 112. At least a portion of the cartridge 104 can be positioned within the cartridge receiving channel 318 when the vaporizer assembly 100 is in the assembled state.

Figure 7B:
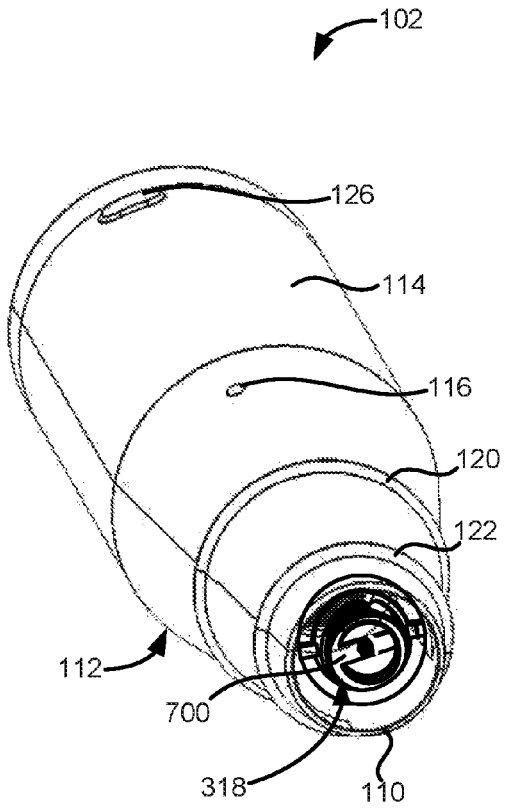
FIG. 7B is a bottom perspective view of another embodiment of the vaporizer.

FIG. 7B is a bottom perspective view of another embodiment of the vaporizer 102. In this embodiment, the vaporizer 102 can comprise a pressure sensing activation unit 700. The pressure sensing activation unit 700 can activate or power on the vaporizer 102 when a change in air pressure is detected by the pressure sensing activation unit 700. The pressure sensing activation unit 700 can comprise a pressure sensor such as a capacitive pressure sensor, an inductive pressure sensor, or a piezoelectric pressure sensor. For example, the pressure sensing activation unit 700 can comprise one or more pressure sensing plates, flaps, other components extending into a part of the airflow pathway 332 within the vaporizer 102. The pressure sensing activation unit 700 can activate or power on the vaporizer 102 when a change in air pressure is detected within a part of the airflow pathway 332 within the vaporizer 102. For example, the pressure sensing activation unit 700 can detect a change in air pressure when the cartridge 104 is coupled to the vaporizer 102 and a user draws air through a mouthpiece attachment 400 attached to the cartridge base 146 or through a chamber of a water pipe 800 (see FIG. 8).

The pressure sensing activation unit 700 can be electrically coupled or connected to the main PCB 208 by wires or circuits. The pressure sensing activation unit 700 can be housed within the frustoconical portion 112. In one embodiment, at least a part of the pressure sensing activation unit 700 can be positioned within the entry chamber 326. In another embodiment, at least a part of the pressure sensing activation unit 700 can be positioned in between the entry chamber 326 and the thread connector 212. In yet additional embodiments, at least a part of the pressure sensing activation unit 700 can be positioned within the narrowing chamber 322. In other embodiments, at least a part of the pressure sensing activation unit 700 can be positioned in between the narrowing chamber 322 and the cartridge receiving channel 318. In all such embodiments, a part of the pressure sensing activation unit 700 (e.g., a pressure sensing plate or flap) can extend or protrude into the airflow pathway 332 within the vaporizer 102. For example, a part of the pressure sensing activation unit 700 can extend or protrude into any part of the airflow pathway 332 depicted in FIG. 3B.

The pressure sensing activation unit 700 can activate or turn on the vaporizer assembly 100 by signaling the microcontroller or other controller on the main PCB 208 to deliver a voltage to the heating element 600. For example, the pressure sensing activation unit 700 can activate or turn on the vaporizer assembly 100 by signaling the microcontroller or other controller on the main PCB 208 to apply a voltage to terminals of the heating coils 604 within the heating chamber 140 to raise the temperature within the heating chamber 140. The pressure sensing activation unit 700 can also activate or turn on the vaporizer assembly 100 by activating the voltage control unit 200. One benefit of the pressure sensing activation unit 700 is allowing users the ability to activate the vaporizer assembly 100 without having to fumble for or find an on-off switch. In addition, the pressure sensing activation unit 700 can also act as a safeguard to prevent the vaporizer 102 or the vaporizer assembly 100 from being inadvertently powered on or turned on when the vaporizer 102 or the vaporizer assembly 100 is inside a user's bag, purse, backpack, pocket, etc.

In alternative embodiment, the voltage selection button 126 can act as an on-off button or switch to activate or turn on the vaporizer assembly 100. In other embodiments, the vaporizer 102 can comprise an additional button besides the voltage selection button 126 to serve as an on-off button or switch.

Figure 8:
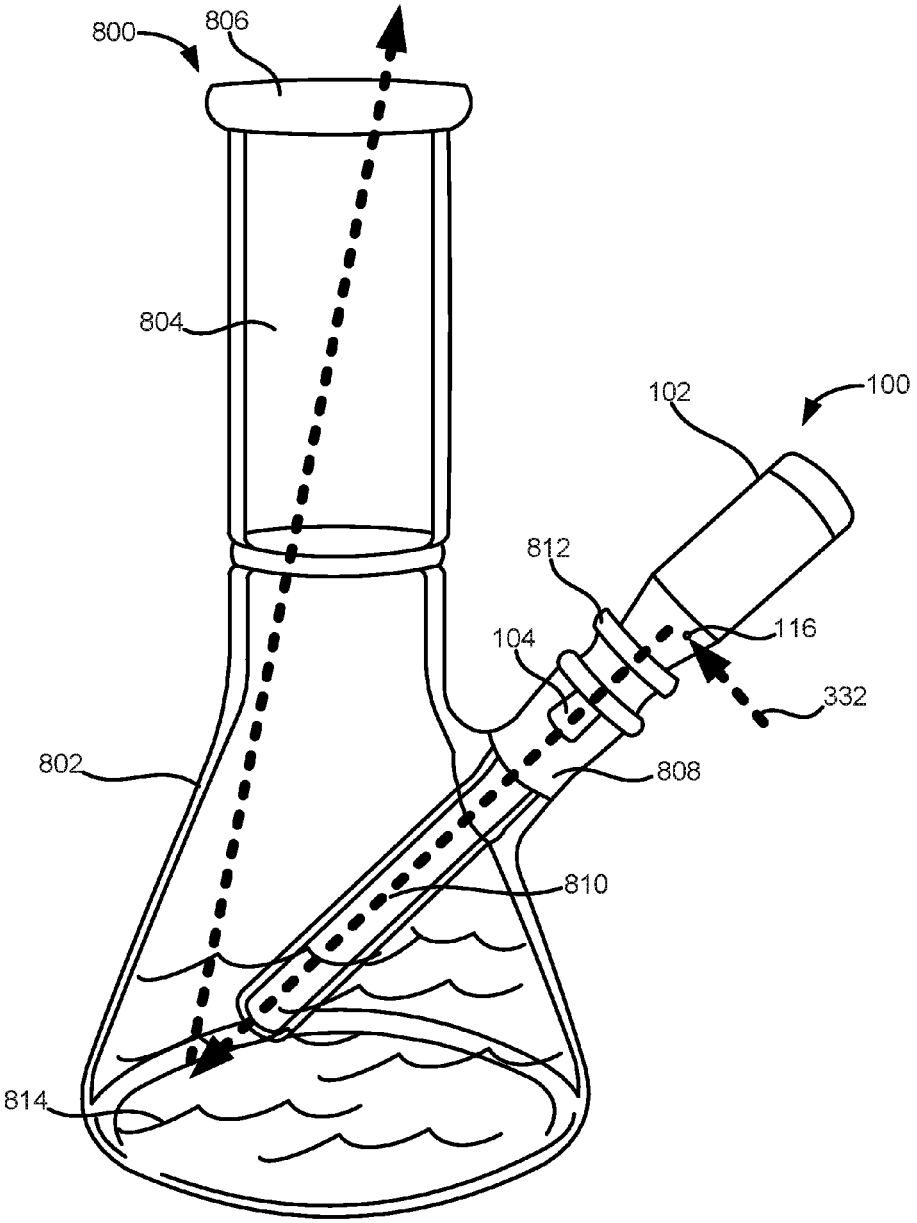
FIG. 8 illustrates one embodiment of the vaporizer assembly used with a water pipe.

FIG. 8 illustrates one embodiment of the vaporizer assembly 100 used with a water pipe 800. As shown in FIG. 8, the water pipe 800 can comprise a reservoir chamber 802 connected to an elongate chamber neck 804. The elongate chamber neck 804 can have a chamber mouthpiece 806 defined along a terminal end of the elongate chamber neck 804. The reservoir chamber 802 can also have a stem outlet 808 protruding from a side of the reservoir chamber 802. The stem outlet 808 can hold a downstem 810 which extends into a reservoir space within the reservoir chamber 802. As depicted in FIG. 8, the stem outlet 808 can hold a bowl 812 or other type of tapered fitted piece. The reservoir chamber 802 can be filled with water 814, iced water, or water 814 with other types of cooling liquids or substances.

In some embodiments, the water pipe 800 can be made of or comprise glass or other type of ceramic material. In other embodiments, the water pipe 800 can be made of an acrylic polymer such as poly(methyl methacrylate) (PMMA).

The assembled vaporizer assembly 100 can be inserted into the bowl 812 or directly into the downstem 810 of the water pipe 800. The frustoconical portion 112 of the vaporizer 102 can be inserted into the bowl 812 or the downstem 810 of the water pipe 800 until at least one of the seal rings (e.g., the first seal ring 120 or the second seal ring 122) forms a substantially air-tight seal around the frustoconical portion 112 within the bowl 812 or within a lumen of the downstem 810. One benefit of the vaporizer assembly 100 having two seal rings of differing diameters is the ability of the vaporizer assembly 100 to be used with water pipes 800 of differing designs and configurations.

One example method of using the vaporizer assembly 100 with the water pipe 800 can involve a user (not shown in FIG. 8) placing the user's mouth on the chamber mouthpiece 806 and creating a substantially air-tight seal around the chamber mouthpiece 806. The user can then inhale with sufficient force to create a suction to draw in air through the airflow entry port 116 on the vaporizer 102. In one variation of the method, air drawn in through the airflow entry port 116 into the airflow pathway 332 can trigger the pressure sensing activation unit 700 to activate or turn on the vaporizer assembly 100. In another variation of the method, the user can turn on the vaporizer assembly 100 by pressing a button on the vaporizer 102. When the vaporizer assembly 100 is activated, the rechargeable battery 204 within the vaporizer 102 can deliver a pre-selected voltage to the heating element 600 to raise the temperature within the heating chamber 140 to between approximately 200° C. and 700° C. in order to heat the vaporizable liquid 516 within the heating chamber 140 into a vapor. Once the vaporizer assembly 100 is activated, the heating chamber 140 can reach its desired heating temperature in approximately 7 to 10 seconds. At this point, the user can inhale once again to draw in air through the airflow entry port 116 into the airflow pathway 332 within the vaporizer assembly 100. Air flowing through the airflow pathway 332 can progress through the frustoconical portion 112 of the vaporizer 102 into the cartridge 104 and carry the vapor generated within the heating chamber 140 through the base lumen 414 and into the downstem 810 of the water pipe 800. The air carrying the vapor can flow downward through the downstem 810 into the water 814 where the water filters and cools the vapor. Finally, the air carrying the vapor can then flow upward through the reservoir chamber 802 into the elongate chamber neck 804 and, eventually, into the user's mouth and lungs.

The aforementioned features of the vaporizer assembly 100 including, but not limited to, the vaporizer housing 106 having the frustoconical portion 112, the airflow entry port 116 along the frustoconical portion 112, the seal rings surrounding the frustoconical portion 112, the cartridge 104 comprising a heating chamber 140 within a fillable cartridge chamber 128, and the heating element 600 within the heating chamber 140 with the set of horizontally positioned heating coils 604, contribute, either individually or in various combinations, to the effective operability of the vaporizer assembly 100 with a water pipe 800. As previously discussed, the vaporizer assembly 100 addresses, to some extent, the inoperability of conventional vaporizers with water pipes 800. Moreover, the dimensions and dimension ranges of the various components and ports described herein optimizes the airflow through the vaporizer assembly 100 and provides the user a more powerful and even hit of vapor. Furthermore, the vaporizer assembly 100 can also be used as a portable handheld vaporizer or a vaporizer pen when a user does not have access to a water pipe 800 or does not feel like using a water pipe 800.

Figure 9:
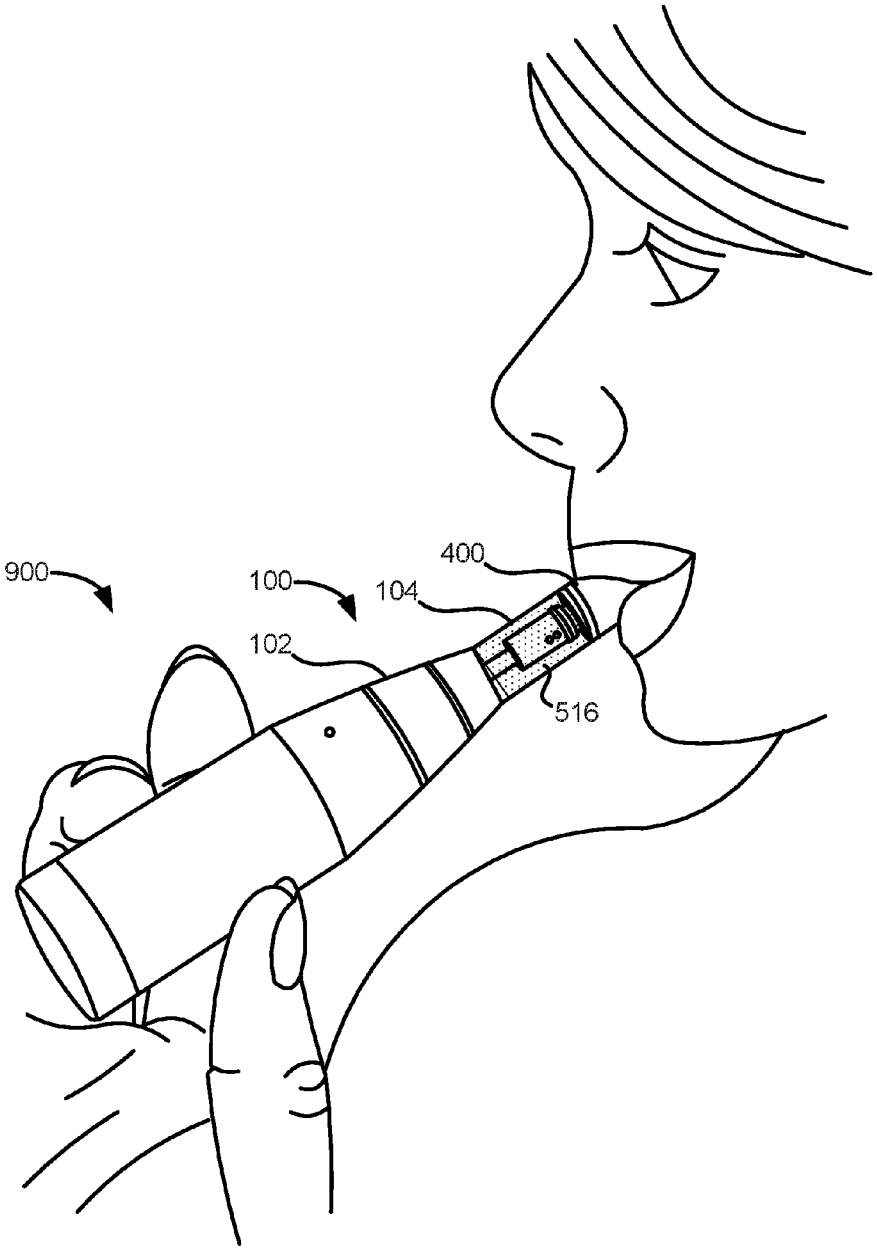
FIG. 9 illustrates another embodiment of the vaporizer assembly used as a portable handheld vaporizer.

FIG. 9 illustrates the vaporizer assembly 100 can have a handheld vaporizer configuration 900 when the mouthpiece attachment 400 is coupled to the cartridge base 146. For example, the mouthpiece attachment 400 can be inserted into a portion of a base lumen 414 (see FIG. 5B). A user can insert a terminal end of the mouthpiece attachment 400 into the user's mouth and draw air through the airflow entry port 116 into the airflow pathway 332 within the vaporizer assembly 100. Air flowing through the airflow pathway 332 can progress through the frustoconical portion 112 of the vaporizer 102 into the cartridge 104 and carry the vapor generated within the heating chamber 140 through the base lumen 414 and into the mouthpiece lumen 402 into the user's mouth and, eventually, the user's lungs.

Each of the individual variations or embodiments described and illustrated herein has discrete components and features which may be readily separated from or combined with the features of any of the other variations or embodiments. Modifications may be made to adapt a particular situation, material, composition of matter, process, process act(s) or step(s) to the objective(s), spirit or scope of the present invention.

Methods recited herein may be carried out in any order of the recited events that is logically possible, as well as the recited order of events. Moreover, additional steps or operations may be provided or steps or operations may be eliminated to achieve the desired result.

Furthermore, where a range of values is provided, every intervening value between the upper and lower limit of that range and any other stated or intervening value in that stated range is encompassed within the invention. Also, any optional feature of the inventive variations described may be set forth and claimed independently, or in combination with any one or more of the features described herein.

All existing subject matter mentioned herein (e.g., publications, patents, patent applications and hardware) is incorporated by reference herein in its entirety except insofar as the subject matter may conflict with that of the present invention (in which case what is present herein shall prevail). The referenced items are provided solely for their disclosure prior to the filing date of the present application. Nothing herein is to be construed as an admission that the present invention is not entitled to antedate such material by virtue of prior invention.

Reference to a singular item, includes the possibility that there are plural of the same items present. More specifically, as used herein and in the appended claims, the singular forms "a," "an," "said" and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation. Unless defined otherwise, all technical and scientific terms used herein have the same meaning as commonly understood by one of ordinary skill in the art to which this invention belongs.

This disclosure is not intended to be limited to the scope of the particular forms set forth, but is intended to cover alternatives, modifications, and equivalents of the variations or embodiments described herein. Further, the scope of the disclosure fully encompasses other variations or embodiments that may become obvious to those skilled in the art in view of this disclosure.

What is claimed is:

1. A vaporizer assembly, comprising:

a vaporizer, wherein the vaporizer comprises:

a vaporizer housing comprising a frustoconical portion, an airflow entry port positioned along the frustoconical portion, wherein the airflow entry port is part of an airflow pathway extending through the vaporizer assembly, and at least one seal ring surrounding the frustoconical portion; and a cartridge coupled to the vaporizer, wherein the cartridge comprises:

a cartridge chamber comprising a chamber wall encapsulating a chamber space configured to hold a vaporizable liquid;

a heating chamber positioned within the cartridge chamber, wherein the heating chamber comprises at least one fluid entrance port along a surface of the heating chamber configured to facilitate entry of the vaporizable liquid from the chamber space into a chamber interior within the heating chamber, and a heating element within the chamber interior configured to heat the vaporizable liquid within the chamber interior into a vapor, wherein the chamber interior is in fluid communication with the airflow pathway and an outside environment, and wherein air flowing through the airflow pathway carries the vapor out of the vaporizer assembly.

2. The vaporizer assembly of claim 1, wherein the cartridge chamber has a chamber proximal end and a chamber distal end opposite the chamber proximal end, wherein the cartridge further comprises a cartridge cap configured to detachably couple to the chamber proximal end, wherein the cartridge has a cartridge entry port, and wherein the cartridge entry port is in fluid communication with the airflow entry port and is part of the airflow pathway.

3. The vaporizer assembly of claim 2, wherein the vaporizer further comprises a magnetic connector, wherein the cartridge cap comprises a metallic component configured to detachably couple to the magnetic connector.

4. The vaporizer assembly of claim 2, wherein the cartridge further comprises an airflow conduit at least partially within the cartridge chamber, wherein the airflow conduit has a conduit lumen and the conduit lumen is part of the airflow pathway.

5. The vaporizer assembly of claim 2, wherein the cartridge further comprises a cartridge base coupled to the chamber distal end, wherein the cartridge base has a base lumen within the cartridge base and the base lumen is in fluid communication with the chamber interior and is part of the airflow pathway, wherein the cartridge base comprises a base connector configured to connect to a mouthpiece attachment.

6. The vaporizer assembly of claim 1, wherein the vaporizer further comprises a pressure sensing activation unit comprising a pressure sensor, wherein at least a part of the pressure sensing activation unit extends into a part of the airflow pathway, wherein the pressure sensing activation unit activates the vapor assembly when a change in air pressure is detected within the airflow pathway.

7. The vaporizer assembly of claim 1, wherein the vaporizer further comprises a plurality of voltage indicator lights and a voltage selection button configured to set a voltage applied to terminals of the heating element, wherein the plurality of voltage indicator lights generate a unique light pattern associated with each of the voltages applied.

8. The vaporizer assembly of claim 1, wherein the heating element of the cartridge comprises at least two heating coils positioned within the chamber interior.

9. The vaporizer assembly of claim 8, wherein the at least two heating coils are resistive heating coils comprising an iron-chromium-aluminum alloy.

10. The vaporizer assembly of claim 9, wherein the at least two heating coils are positioned substantially horizontal within the chamber interior such that a coil longitudinal axis of one of the two heating coils is substantially perpendicular to a chamber longitudinal axis of the heating chamber.

11. The vaporizer assembly of claim 9, wherein each of the at least two heating coils is wound around a wicking material configured to soak up the vaporizable liquid.

12. The vaporizer assembly of claim 1, wherein at least part of the chamber wall is made from a transparent glass material.

13. The vaporizer assembly of claim 1, wherein the airflow entry port is a circular port and the airflow entry port has a diameter between 1.3 mm and 1.5 mm.

14. The vaporizer assembly of claim 2, wherein the cartridge entry port is a circular port and the cartridge entry port has a diameter between 1.3 mm and 1.5 mm.

15. The vaporizer assembly of claim 1, wherein at least a portion of the cartridge is positioned within the frustoconical portion of the vaporizer when the cartridge is coupled to the vaporizer and wherein at least another portion of the cartridge surrounding the heating chamber is positioned outside of the frustoconical portion when the cartridge is coupled to the vaporizer.

16. The vaporizer assembly of claim 1, wherein the cartridge further comprises an insulator within the chamber interior and coupled to the heating element.

17. A vaporizer, comprising:

a vaporizer housing having a housing proximal end and a housing distal end opposite the housing proximal end, wherein the vaporizer housing comprises a tubular portion configured to house a rechargeable battery and a frustoconical portion coupled to the tubular portion, wherein the frustoconical portion has a cartridge receiving channel extending from the housing distal end into an interior of the frustoconical portion;

an airflow entry port positioned along an exterior surface of the frustoconical portion, wherein the airflow entry port is in fluid communication with the cartridge receiving channel;

a battery charging port and an electronic assembly housed within the frustoconical portion, wherein the electronic assembly comprises a printed circuit board and a microcontroller;

a magnetic connector housed within the frustoconical portion and positioned at an end of the cartridge receiving channel; and an indicator portion coupled to the housing proximal end, where the indicator portion comprises a plurality of voltage indicator lights.

18. The vaporizer of claim 17, wherein the vaporizer housing is made from an aluminum alloy.

* * * * *